US007867678B2

(12) United States Patent
Ciaschi et al.

(10) Patent No.: US 7,867,678 B2
(45) Date of Patent: Jan. 11, 2011

(54) TONER FOR USE IN A CHILLED FINISH ROLLER SYSTEM

(75) Inventors: Andrew Ciaschi, Pittsford, NY (US); Dinesh Tyagi, Fairport, NY (US); James H. Hurst, Rochester, NY (US); Arun Chowdry, Pittsford, NY (US); Eric C. Stelter, Pittsford, NY (US); Robert D. Bobo, Ontario, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/476,282

(22) Filed: Jun. 2, 2009

(65) Prior Publication Data

US 2009/0239172 A1 Sep. 24, 2009

Related U.S. Application Data

(62) Division of application No. 11/445,022, filed on Jun. 1, 2006, now abandoned.

(51) Int. Cl.
*G03G 9/00* (2006.01)

(52) U.S. Cl. ..... 430/108.1; 430/109.1; 430/111.4

(58) Field of Classification Search ..... 430/108.1, 430/109.1, 111.4
See application file for complete search history.

(56) References Cited

U.S. PATENT DOCUMENTS

| | | | | |
|---|---|---|---|---|
| 3,893,935 | A | 7/1975 | Jadwin et al. | |
| 4,079,014 | A | 3/1978 | Burness et al. | |
| 4,140,644 | A | 2/1979 | Sandhu et al. | |
| 4,217,400 | A | 8/1980 | Leffingwell | |
| 4,323,634 | A | 4/1982 | Jadwin | |
| RE31,072 | E | 11/1982 | Jadwin et al. | |
| 4,394,430 | A | 7/1983 | Jadwin et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,814,250 | A | 3/1989 | Kwarta et al. | |
| 4,833,060 | A | 5/1989 | Nair et al. | |
| 4,834,920 | A | 5/1989 | Bugner et al. | |
| 4,840,864 | A | 6/1989 | Bugner et al. | |
| 5,019,869 | A | 5/1991 | Patton | |
| 5,249,949 | A | 10/1993 | Aslam et al. | |
| 5,731,121 | A * | 3/1998 | Asanae et al. | 430/108.4 |
| 5,805,969 | A | 9/1998 | Elsermans | |
| 5,905,012 | A | 5/1999 | DeMeutter et al. | |
| 6,121,986 | A | 9/2000 | Regelsberger et al. | |
| 6,156,473 | A | 12/2000 | Tyagi et al. | |

(Continued)

FOREIGN PATENT DOCUMENTS

| | | |
|---|---|---|
| EP | 0758766 | 2/1997 |

(Continued)

*Primary Examiner*—Mark A Chapman
(74) *Attorney, Agent, or Firm*—Donna P. Suchy

(57) ABSTRACT

A toner composition for fixing onto a receiver in conjunction with non-contact fuser capable of fusing one or more layers of toner on the receiver such that one or more toner layers reach a fusing temperature above a glass transition temperature. One or more cooling finish rollers are located downstream from the non-contact fuser to lower the toner temperature.

7 Claims, 11 Drawing Sheets

U.S. PATENT DOCUMENTS

| | | | |
|---|---|---|---|
| 6,342,273 | B1 | 1/2002 | Handels et al. |
| 6,587,665 | B2 | 7/2003 | Bartscher et al. |
| 6,608,986 | B2 | 8/2003 | Bartscher et al. |
| 6,608,987 | B2 | 8/2003 | Bartscher et al. |
| 6,615,018 | B2 | 9/2003 | Funato |
| 6,665,516 | B2 | 12/2003 | Morgenweck et al. |
| 6,683,287 | B2 | 1/2004 | Behnke et al. |
| 6,686,573 | B2 | 2/2004 | Behnke |
| 6,740,462 | B2 | 5/2004 | Bartscher et al. |
| 6,916,583 | B1 | 7/2005 | Landa |
| 7,054,572 | B2 | 5/2006 | Baruch et al. |
| 2004/0190925 | A1 | 9/2004 | Baruch et al. |
| 2005/0196204 | A1 | 9/2005 | Funato et al. |
| 2005/0202164 | A1 | 9/2005 | Stelter et al. |
| 2005/0207807 | A1 | 9/2005 | Tombs |

FOREIGN PATENT DOCUMENTS

| | | |
|---|---|---|
| JP | 2002-006672 | 1/2002 |

* cited by examiner

TONER FOR USE IN A CHILLED FINISH ROLLER SYSTEM

CROSS REFERENCE TO RELATED APPLICATIONS

This application is a divisional of prior U.S. patent application Ser. No. 11/445,022 filed 1 Jun. 2006 now abandoned which is hereby incorporated by reference in its entirety.

FIELD OF THE INVENTION

The invention relates generally to the field of print finishing, and more particularly to a device and method for fixing toner onto a substrate, also referred to as a receiver, using chilled finish rollers.

BACKGROUND OF THE INVENTION

Many electrographic printers/copiers use rollers to feed material to a nip near a web. A pressure sensitive roller and a heated roller form a nip. During fusing, after printing, the pressure sensitive roller and heated roller are in pressure contact with one another in what is referred to as contact fusing. If heated rollers do not contact the substrate it is referred to as non-contact fusing.

In electrographic printers many of the non-contact fusing systems have suffered from the absence of a contact roller for toner dot spreading, which acts as an assist for toner/substrate surface wetting and gloss modulation. This is due to the fact that the surface finish of the roller coating is normally used to act as a gloss modulator in contact fusing systems but is not available in the non-contact fusing systems currently available. Without the use of the roller, the non-contact fuser can cause large differences in toner gloss (luster) from light scattering off of separate toner particles at low to mid range color densities that produce low gloss, and solid high density layers of toner that produce high gloss. Rollers tend to modulate the gloss to near the finish of the roller coating except when toner particles are separated enough to scatter light at low lay-downs (or low to mid range color densities), where the rollers tend to spread the toner dots to reduce the light scattering effect that produces low gloss.

Non-contact systems toner formulations can also produce various limitations for non-contact fusing image quality. Many non-contact fusers operate in conjunction with a toner that has a sharp melting point and attains a low enough viscosity to attain a high gloss level at high toner lay-downs (highest color densities). These toner types tend to have other associated problems such as cratering which leads to poor quality results. Cratering can be attributed to volatiles escaping through a molten toner layer: gasses push their way through the molten toner layer leaving a toner void surrounded by a rim of toner that looks very similar to a volcanic crater, or a meteor crater. In some cases the non-wetting of the toner melt can lead to image artifacts such as lower gloss and image density in a manner similar to cratering. The chilled finish roller described below works in conjunction with toners with crystalline additives to overcome these difficulties and produce a high quality product.

SUMMARY OF THE INVENTION

In accordance with an object of the invention, both an apparatus and a method are provided for improving the quality of print finishes using a non-contact fuser of toner on the substrate, in conjunction with cooling finish rollers located subsequent the fuser, such that the toner deposited on the substrate exhibits a sharp increase of the modulus of elasticity when it contacts the cooler rollers. The cooler rollers also provide pressure to assist image dot spreading for increased color density in low color density areas, and to cast the roller surface texture onto the toner surface to modulate the gloss to the desired levels, and to cool crystalline sites at a specific rate to also modulate the gloss levels.

While the specification concludes with claims particularly pointing out and distinctly claiming the subject matter of the present invention, it is believed the invention will be better understood from the following detailed description when taken in conjunction with the accompanying drawings.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

Figure 1A:
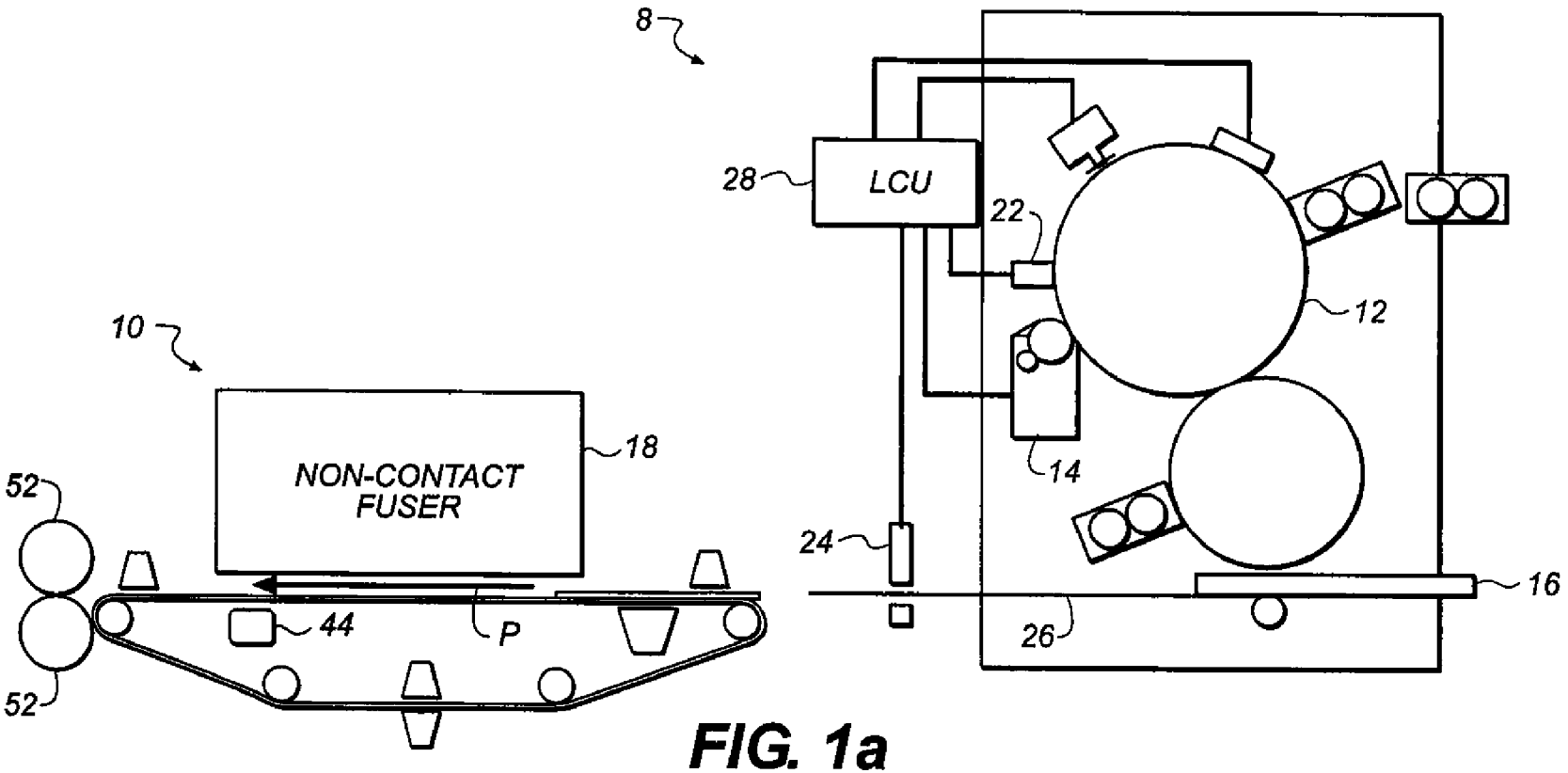
FIG. 1*a* shows an electrographic print engine.

FIG. 1*a* shows generally, schematically, a portion of an electrographic apparatus 8 with a chilled finish roller system 10, generally referred to as an electrographic printer which incorporates a printing system in accordance with the methods and systems described below.

The electrographic printer 8 includes a moving electrographic imaging member such as a photoconductive drum 12, which is driven by a motor to advance the drum, which advances the receiver 16 in the direction indicated by arrow P. Alternatively, drum 12 may be a belt that is wrapped around a drum or it may be a belt that is wrapped around one or more rollers.

The electrographic apparatus 8 includes a controller or logic and control unit (LCU) 28 that is programmed to provide closed-loop control of printer 8 in response to signals from various sensors and encoders. Aspects of process control are described in U.S. Pat. No. 6,121,986 incorporated herein by this reference. In the electrographic apparatus 8, a toner development station) is provided for storing a supply of toner particles and selectively depositing toner 14 particles on a latent image charge photoconductive drum 12. When the charge on the toner particles is at a proper level, the particles will develop the latent image charge patterns into a suitable visible image. Thereafter, the visible toner particles image is transferred to a receiver member 16, which is often referred to as a substrate or receiver, and is fixed to the receiver member by a non-contact fuser 18, to form the desired image. One skilled in the art understands that the receiver could be paper that is printed or non-printed or a non-paper, such as metal, ceramics, photoconductor, textile, glass, plastic sheet, metal sheet, paper sheet and other bases that are capable of receiving a toner or toner related material.

The chilled finish roller system 10 works in conjunction with toners that do not crater because they use crystalline additives for reducing the melt viscosity. Toners with crystalline additives have a physical behavior related to cooling that can be exploited for gloss attenuation. The faster these materials are cooled the smaller the crystalline sites, and the smaller the crystalline sites the higher the gloss. The chilled finish roller system 10 and related method work in conjunction with these properties by cooling the toner at various rates to attain various levels of gloss that depend on the toner-melt flow characteristics and crystalline content. The chilled finish rollers can also provide pressure for dot spreading (calender), and roller surface casting onto the toner surface to control the final gloss. These materials are referred to as "sharp melting point toners."

Materials

Any suitable thermoplastic vinyl polymer may be employed in the practice of the present invention, including homopolymers or copolymers of two or more vinyl monomers. Typical of such vinyl monomeric units include: styrene, p-chlorostyrene, vinylnaphthaline, mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butyl acrylate, isobutyl acrylate, n-octyl acrylate, dodecyl acrylate, 2-chloroethyl acrylate, phenyl acrylate, methyl alphachloroacrylate, methyl methacrylate, ethyl methacrylate, butyl methacrylate and the like; acrylonitrile, methacrylonitrile acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidine and the like; and mixtures thereof.

Generally polymers containing relatively high percentages of styrene are preferred. The styrene resin employed may be a homopolymer of styrene, or of styrene homologs of copolymers of styrene with other monomeric groups. Any of the above typical monomeric units may be copolymerized with styrene by addition polymerization. Styrene resins also may be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired. However, non-vinyl type thermoplastic resins also may be employed such as modified phenolformaldehyde resins, oil modified epoxy resins, polyurethane resins, cellulosic resins, polyether resins, and mixtures thereof.

Especially useful resins are styrenic polymers of from 40 to 100 percent by weight of styrene or styrene homologs and from 0 to 45 percent by weight of one or more alkyl acrylates or methacrylates. Preferably, but not necessarily, this is a lower alkyl acrylate or methacrylate in which the alkyl group contains from 1 to 4 carbon atoms. Examples include methyl acrylate, ethyl acrylate, n-butyl acrylate, isobutyl acrylate, n-octyl acrylate, dodecyl acrylate, 2-chloroethyl acrylate, methyl methacrylate, ethyl methacrylate, butyl methacrylate and the like. Particularly useful polymers are styrene polymers of from 60 to 95 percent by weight of styrene or styrene homologs such as .alpha.-methylstyrene, o-methylstyrene, p-methylstyrene, p-ethylstyrene, 2,4-dimethylstyrene, p-n-hexylstyrene, p-n-octylstyrene, p-tert-butylstyrene, p-n-nonylstyrene, p-n-phenylstyrene and the like and from 5 to 40 percent, by weight, of one or more lower alkyl acrylates or methacrylates. Fusible styrene-acrylic copolymers, which are covalently, lightly crosslinked with a divinyl compound such as divinylbenzene as disclosed in the aforementioned patent to Jadwin, U.S. Pat. No. Re. 31,072 also is especially useful in the practice of the present invention.

Vinyl polymers useful in the polyblends of the present invention should have a number average molecular weight of at least 1,000 and preferably from 2,000 to 20,000. Vinyl polymers suitable for use in the polyblends of the present invention also should have a glass transition temperature (Tg) of from about 50.degree. to 100.degree. C. Especially useful condensation polymers in the polyblends of the present invention are amorphous polyesters having a glass transition temperature of 50.degree. to 100.degree. C. and a number average molecular weight of at least 1,000, preferably from about 2,000, to 20,000 prepared by reacting the usual types of polyester monomers. Also useful are crystalline polyesters having a melting temperature (Tm) of about 50.degree. to 125.degree. C. and a number average molecular weight of at least 1,000, preferably 2,000 to 20,000.

Monomers useful in preparing polyesters used in this invention include: 1,4-cyclohexanediol; 1,4-cyclohexanedimethanol; 1,4-cyclohexanediethanol; 1,4-bis(2-hydroxyethoxy)-cyclohexane; 1,4-benzenedimethanol; 1,4-benzenediethanol; norbornylene glycol; decahydro-2,6-naphthalenedimethanol; bisphenol A; ethylene glycol; diethylene glycol; triethylene glycol; 1,2-propanediol, 1,3-propanediol; 1,4-butanediol; 2,3-butanediol; 1,5-pentanediol; neopentyl glycol; 1,6-hexanediol; 1,7-heptanediol; 1,8-octanediol; 1,9-nonanediol; 1,10-decanediol; 1,12-dodecanediol; 2,2,4-trimethyl-1,6-hexanediol; and 4-oxa-2,6-heptanediol.

Suitable dicarboxylic acids include: succinic acid; sebacic acid; 2-methyladipic acid; diglycolic acid; thiodiglycolic acid; fumaric acid; adipic acid; glutaric acid; cyclohexane-1,3-dicarboxylic acid; cyclohexane-1,4-dicarboxylic acid; cyclopentane-1,3-dicarboxylic acid; 2,5-norbornanedicarboxylic acid; phthalic acid; isophthalic acid; terephthalic acid; 5-butylisophthalic acid; 2,6-naphthalenedicarboxylic acid; 1,4-naphthalenedicarboxylic acid; 1,5-naphthalenedicarboxylic acid; 4,4'-sulfonyldibenzoic acid; 4,4'-oxydibenzoic acid; binaphthyldicarboxylic acid; and lower alkyl esters of the acids mentioned.

Polyfunctional compounds having three or more carboxyl groups, and three or more hydroxyl groups are desirably employed to create branching in the polyester chain. Triols, tetraols, tricarboxylic acids, and functional equivalents, such as pentaerythritol, 1,3,5-trihydroxypentane, 1,5-dihydroxy-3-ethyl-3-(2-hydroxyethyl)pentane, trimethylolpropane, trimellitic anhydride, pyromellitic dianhydride, and the like are suitable branching agents. Presently preferred polyols are glycerol and trimethylolpropane. Preferably, up to about 15 mole percent, preferably 5 mole percent, of the reactant monomers for producing the polyesters can be comprised of at least one polyol having a functionality greater than two or polyacid having a functionality greater than two.

Other important components of the toner composition necessary for use in this application are rheology modifiers. Although melt viscosity can be reduced by the lowering of the polymer molecular weight, it is achieved at the expense of increased polymer brittleness and lower glass transition temperature. The former will negatively impact the image durability. The developer life is also reduced by the generation of very small particles that can break off from the toner particles. Lower binder glass transition impacts both the toner keep in the bottle as well as the print keeping. Different types of rheology modifiers are possible, but the preferred rheology modifiers include an aliphatic amide or aliphatic acid.

Preferred rheology modifiers would have melting temperature in the range of 60 to 120° C. and would act in a manner to lower the melt viscosity of the polymers when melted. On cooling, however, they would phase separate and recrystallize as separate domains. In this manner, they would affect the Tg of the toner resin. Suitable aliphatic amides and aliphatic acids are described, for example, in "Practical Organic Chemistry", Arthur I. Vogel, 3rd Ed. John Wiley and Sons, Inc. N.Y. (1962); and "Thermoplastic Additives: Theory and Practice" John T. Lutz Jr. Ed., Marcel Deckker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ethylene bis(oleamide), ethylene bis(stearamide), ethylene bis(behenamide) and long chain acids including stearic, lauric, montanic, behenic, oleic and tall oil acids. Particularly preferred aliphatic amides and acids include stearamide, erucamide, ethylene bis-stearamide and stearic acid.

The aliphatic amide or aliphatic acid is present in an amount from 2.5 to 30 percent by weight, preferably from about 5 to 8 percent by weight. Mixtures of aliphatic amides and aliphatic acids can also be used. One useful stearamide is commercially available from Witco Corporation as KENAMIDE™.S. A useful stearic acid is available from Witco Corporation as HYSTERENE™. 9718.

Figure 1B:
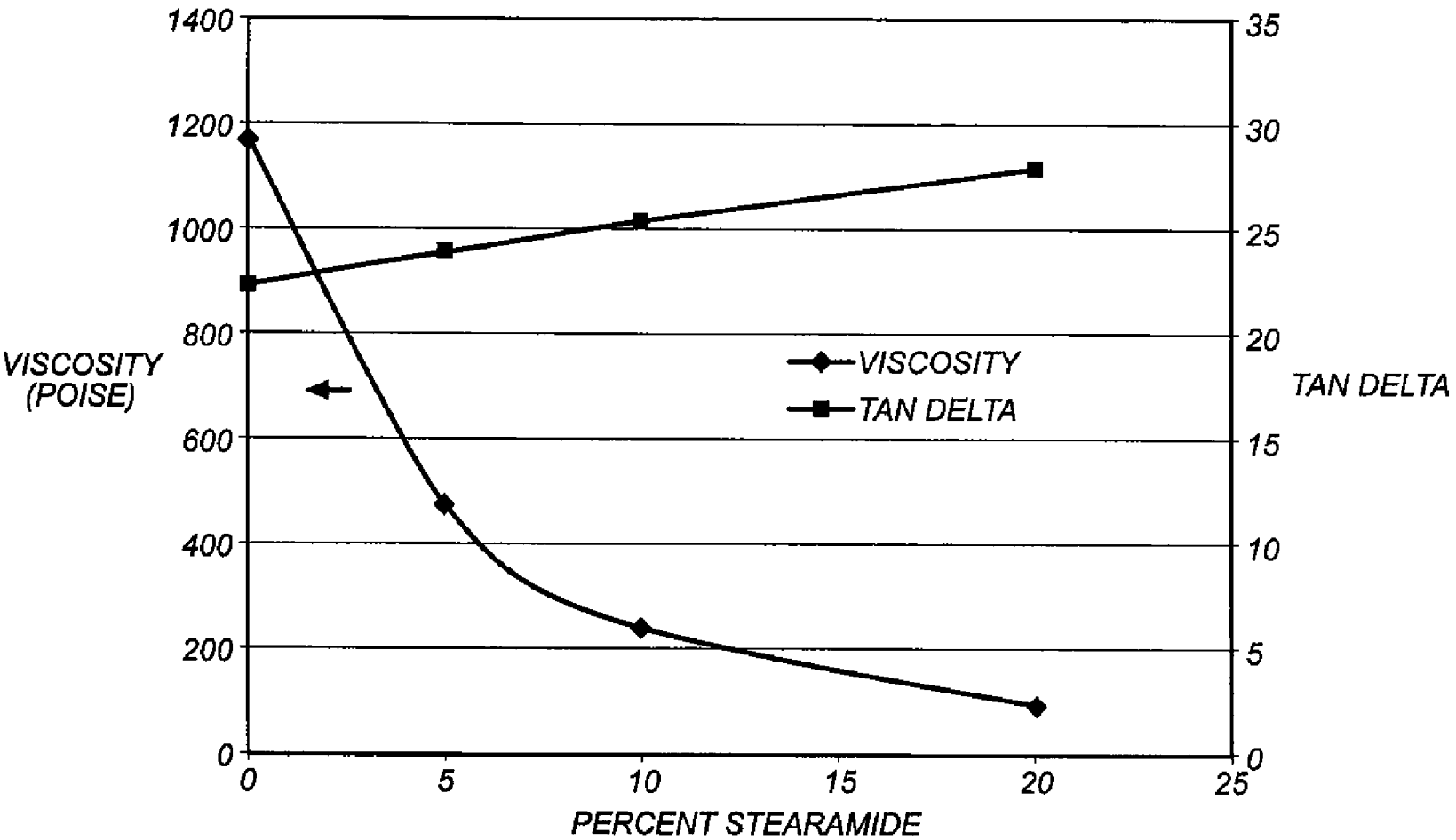
FIG. 1*b* shows a graph of viscosity as a percent of stearavide for Kao Binder TF-90.

The purpose of the special crystalline additive (stearamide) that we incorporate in otherwise amorphous toner is simply to lower the viscosity. As we add more of this crystalline "rheology modifier" our viscosity is lowered as shown in FIG. 1*b*. The curve below is for Kao Binder TF-90. Other binders are similar and one skilled in the art would understand that they could be used in conjunction with the apparatus described in FIG. 1*b*.

The concentration of the aliphatic amide or aliphatic acid in the toner composition is from 2.5 to 30% by weight of the toner composition. This concentration is somewhat greater than the concentration of prior art compositions where the aliphatic amide or aliphatic acid is used as a release agent. For that function, the weight percent is usually in the range of 1-2% by weight. This concentration is somewhat less than the concentration of prior art compositions where the aliphatic amide or aliphatic acid is used as a pressure fixing binder. As noted previously, such pressure fixing compositions require at least about 35% by weight of a waxy substance and typically much higher weight percentage. Variations in the relative amounts of each of the respective monomer reactants are possible for optimizing the physical properties of the polymer.

The polyesters used in this invention are conveniently prepared by any of the known polycondensation techniques, e.g., solution polycondensation or catalyzed melt-phase polycondensation; for example, by the transesterification of dimethyl terephthalate, dimethyl glutarate, 1,2-propanediol and glycerol. The polyesters also can be prepared by two-stage polyesterification procedures, such as those described in U.S. Pat. Nos. 4,140,644 and 4,217,400. The latter patent is particularly relevant, because it is directed to the control of branching in polyesterification. In such processes, the reactant glycols and dicarboxylic acids, are heated with a polyfunctional compound, such as a triol or tricarboxylic acid, and an esterification catalyst in an inert atmosphere at temperatures of 190.degree. to 280.degree. C., preferably 200.degree. to 260.degree. C. Subsequently, a vacuum is applied, while the reaction mixture temperature is maintained at 220.degree. to 240.degree. C., to increase the product's molecular weight.

One presently preferred class of polyesters comprises residues derived from the polyesterification of a polymerizable monomer composition comprising;

a dicarboxylic acid-derived component comprising: about 75 to 100 mole percent of dimethyl terephthalate and about 0 to 25 mole percent of dimethyl glutarate and a diol/polyol-derived component comprising: about 90 to 100 mole percent of 1,2-propane diol and about 0 to 10 mole % of glycerol. The term "charge-control" refers to a propensity of a toner addendum to modify the triboelectric charging properties of the resulting toner. A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used.

Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarb oxamidato(2-)], ammonium, sodium, and hydrogen (Organoiron available from Hodogaya Chemical Company Ltd.). Charge control agents are generally employed in small quantities, such as 0.1 to 3 weight percent, preferably 0.2 to 1.5 weight percent, on a total toner powder weight basis. Another optional but preferred starting material for inclusion in the polymer composition is a colorant in the form of a pigment or dye which imparts color to the electrophotographic image fused to paper. Suitable dyes and pigments are disclosed, for example, in the aforementioned U.S. Pat. No. Re. 31,072. Colorants are generally employed in quantities of 1 to 30 weight percent, preferably 1 to 8 weight percent, on a total toner powder weight basis.

Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index volumes 1 and 2, Second Edition. Included among the vast numbers of useful colorants are those dyes and/or pigments that are typically employed as blue, green, red, yellow, magenta and cyan colorants used in electrostatographic toners to make color copies. Examples of useful colorants are Hansa Yellow G (C.I. 11680), Nigrosine Spirit soluble (C.I. 50415), Chromogen Black ETOO (C.I. 45170), Solvent Black 3 (C.I. 26150), Hostaperm Pink E-02 (Hoechst-Celanese), Fuchsine N (C.I. 42510), C.I. Basic Blue 9 (C.I. 52015) and Pigment Blue 15:3 (C.I. 74160). Carbon black also provides a useful colorant.

Various kinds of other well-known addenda (e.g., release agents, such as conventionally used polysiloxanes or waxes, magnetic materials, etc.) also can be incorporated into the toners of the invention.

In the present invention, at least one release agent is preferably present in the toner formulation. An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others. The wax is optionally present in an amount of from about 0.1 to about 10 wt % and more preferably in an amount of from about 0.5 to about 5 wt % based on the toner weight. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole.

Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient Corporation. The toner composition of this invention can be made by melt processing the polymer binder in for example a two roll mill or extruder. This procedure can include melt blending of other materials with the polymer, such as toner addenda and colorants. A performed mechanical blend of the binder polymer, colorants and other toner additives can be prepared, and then roll milled or extruded. The roll milling, extrusion, or other melt processing is performed at a temperature sufficient to achieve a uniformly blended composition.

The resulting material, referred to as a "melt product" or "melt slab" is then cooled. For a polymer having a Tg in the range of about 50.degree. C. to about 120.degree. C., or a T.sub.m in the range of about 65.degree. C. to about 200.degree. C., a melt blending temperature in the range of about 90.degree. C. to about 240.degree. C. is suitable using a roll mill or extruder. Melt blending times, that is, the exposure period for melt blending at elevated temperature, are in the range of about 1 to about 60 minutes. The melt product is cooled and then pulverized to a volume average particle size of from about 4 to 20, preferably 5 to 12 micrometers. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472 and can then be classified in one or more steps.

The toner composition of this invention can alternatively be made by dissolving the polymer in a solvent in which the charge control agent and other additives are also dissolved or are dispersed. The resulting solution can then be spray dried to produce particulate toner powders. Methods of this type include limited coalescence polymer suspension procedures as disclosed in U.S. Pat. No. 4,833,060, which are particularly useful for producing small, uniform toner particles. The melt viscosity of the preferred toner should display a sharp drop in viscosity when heated. This sharp drop is achieved with addition of highly crystalline rheology modifiers. The preferred melt viscosity of the toner would be in the range of 200 to 20,000 poise or more preferably between 400 and 2000 poise. These measurements are carried out on a Rheometrics rheospectrophotometer Model RDA 700 at 120 C and at a frequency of 1 rad/sec using parallel plate geometry. The term "particle size," "size," or "sized" as used herein in reference to the term "particles", means the median volume weighted diameter as measured by conventional diameter measuring devices, such as a Coulter Multisizer, sold by Coulter, Inc. of Hialeah, Fla. The median volume weighted diameter is the diameter of an equivalent weight spherical particle, which represents the median for a sample.

In the preferred embodiments, the toner is part of a two-component developer, which comprises from about 1 to about 20 percent by weight of toner and from about 80 to about 99 percent by weight of carrier particles. Usually, carrier particles are larger than toner particles. Carrier particles can have a particle size of from about 5 to about 1200 micrometers and are generally from 5 to 200 micrometers, whereas the toner particles preferably have a size from 4 to 20 microns. The developer can be made by simply mixing the toner and the carrier in a suitable mixing device. The components are mixed until the developer achieves a maximum charge. Useful mixing devices include roll mills and other high energy mixing devices.

The developer comprising the toner of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After imagewise deposition of the toner particles the image can be fixed, for example, by heating the toner to cause it to fuse to the receiver carrying the toner. If desired, the unfused image can be transferred to a receiver such as a blank sheet of copy paper and then fused to form a permanent image.

TABLE I

| Typical Toner formulation (by weight): | |
|---|---|
| Polymer binder | 70 to 95% |
| Rheology Modifier | 5 to 25% |
| CCA (optional) | 0.1 to 3% |
| Colorant (optional) | 2 to 10% |

Substrate Transport for Cut Sheet Media

Figure 2:
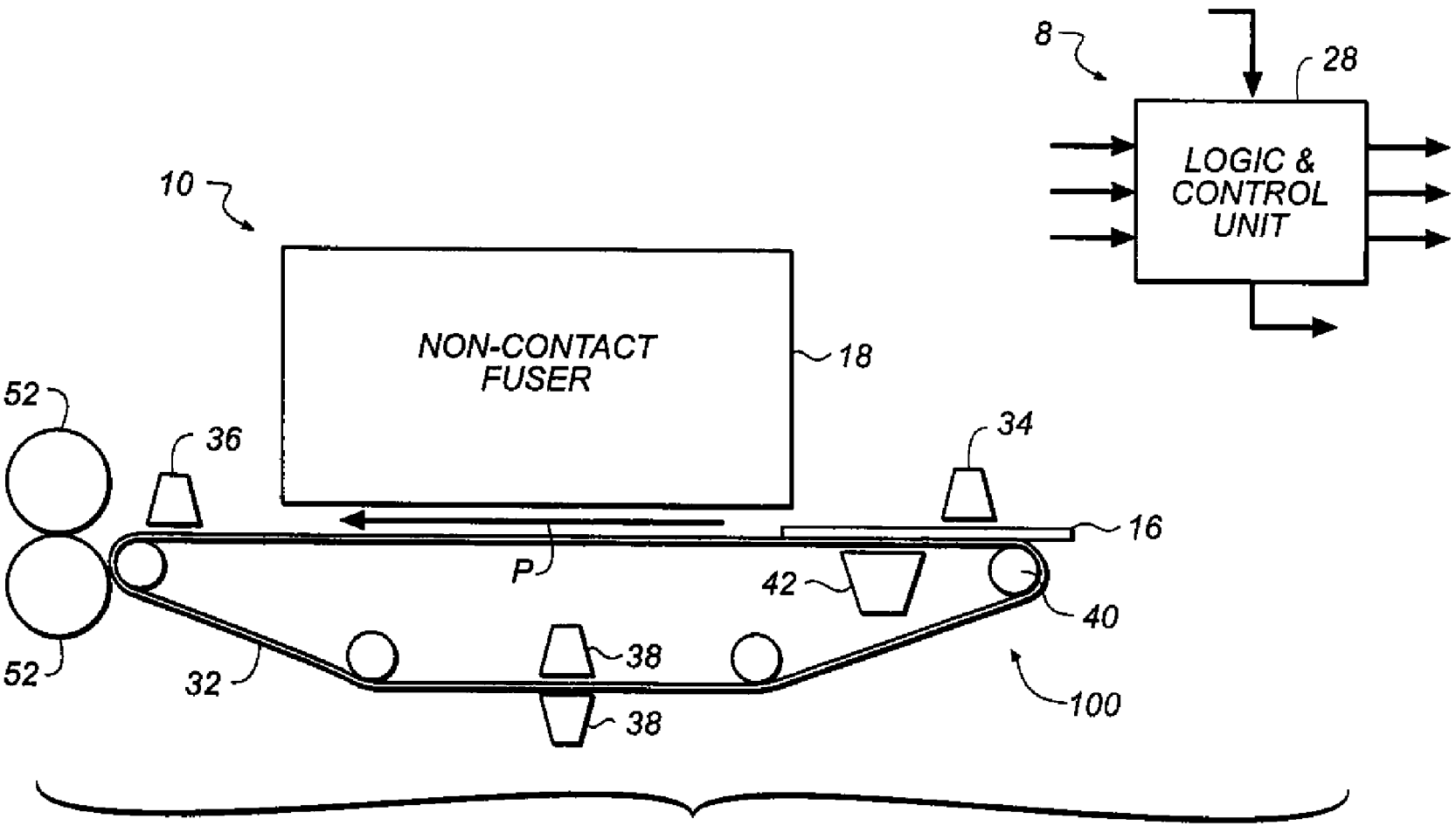
FIG. 2 shows an electrostatic web subsystem.

FIG. 2 shows an electrostatic web subsystem 100 that cooperates with and can be threaded through the non-contact fuser 18, and consists of a high temperature resistant web 32, at least two rollers and two direct current (DC) corona chargers (one for tack-down 34 and one for de-tack 36). Another corona charger 38, with alternating current (AC) can be used to condition the belt for optimum charging. Direct current chargers apply a specific electrostatic charge onto surfaces, which create electrostatic forces that either hold down the substrate or release the substrate, and alternating current chargers erase any residual charge to leave a net zero charge so that the proper charge can be applied by the tack-down charger 34. This web also needs to be heated to a specific initial temperature, depending on the needs of the fusing process and materials. This is most important during initial heat-up from a cold start. A heated roller 40, or radiant heater 42 could be used. Cooling the web 32 may be necessary, since it is not cooled by the chill rollers 52, to minimize duplex image artifacts, due to web contact on the first side image, during the second pass. Air knives 44 could be used. Air knives are devices that blow air at high velocity onto surfaces. The shape of the air exit orifice is defined by the word "knives:" this means the exit orifice has a long thin rectangular shape. The impact of the air onto a surface is like that of a knife-edge.

Figure 2B:
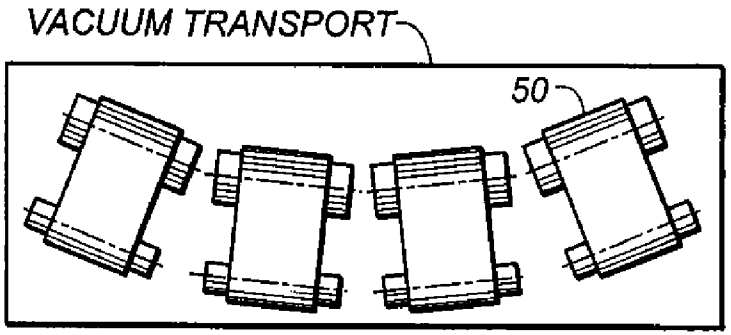
FIGS. 2*a*, 2*b*, and 2*c* show a fusing system with a curved paper path and a vacuum substrate transport.
Figure 2C:
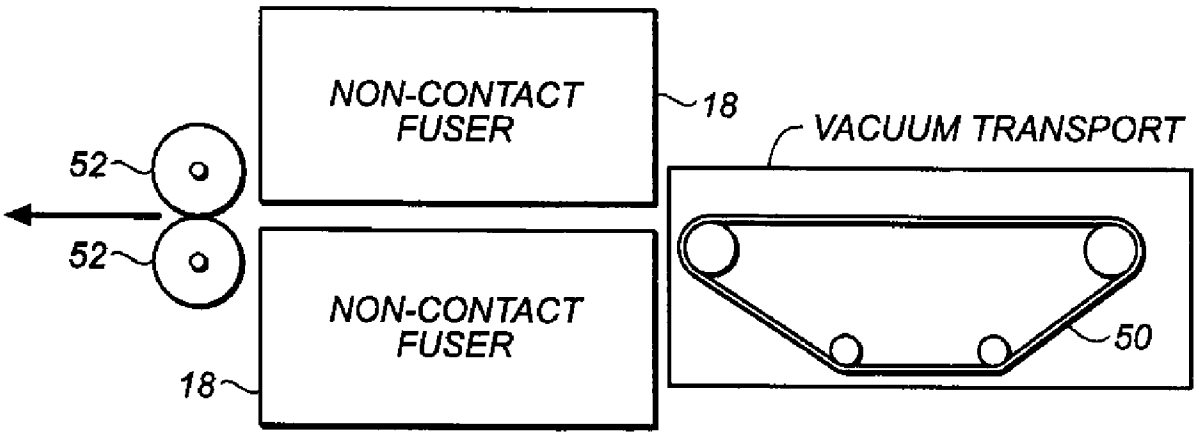
Figure 2A:
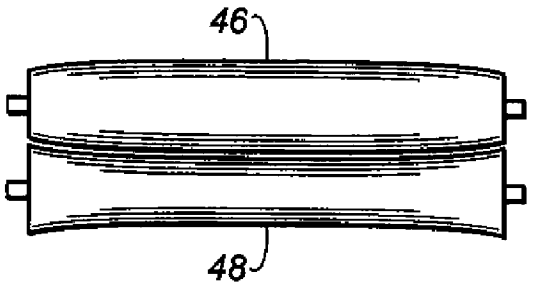

In one embodiment the electrographic apparatus with a chilled finish roller system 10 includes a vacuum belt system with crowned rollers, 46 and 48, and curved paper path (see FIGS. 2*a* & 2*b*). Vacuum transport belts are well known in the art. Crowned rollers are well known in the art, but not often used. Vacuum belts 50 (see FIGS. 2*b* & 2*c*) would deliver the substrate to the non-contact fuser 18, and push it through the fuser until the substrate reaches chill rollers 52. The vacuum belts 50 would not enter the non-contact fuser 18, and the entire fuser paper path would be curved in the transverse direction, with respect to the process direction (see FIG. 2*b*).

This curvature gives the substrate a shape that has a higher stiffness in the process direction than if it was not curved. This allows for total non-contact through the fuser itself. This curvature would need to be maintained through the entire fuser path from the entrance vacuum belt 50 to the exit of the chilled finish rollers 52. The chilled finish rollers 52 would also need to maintain this curvature by having one roller 48 that is concave (see FIG. 2*a*) in the transverse direction, and the other roller 44 and is convex. This curved shape results in a stiffer substrate in the process direction, will also improve the substrate's release from the finishing roller 52 by increasing the peel force that overcomes the adhesion forces.

Non-Contact Fusers

The electrographic apparatus with a chilled finish roller system can be used in conjunction with all known types of non-contact fusers. Flash fusing consists of short bursts of radiant near infrared (NIR) energy. Infrared fusing is a slower process than flash fusing, and applies mid and far infrared energy. Ultraviolet (UV) fusing applies mostly UV energy, but there is residual infrared energy that assists in the heating process. Hot air fusing uses hot air convection to transfer heat to the toner and substrate. Microwave fusing applies a high-energy electromagnetic field at 2.45 Ghz that excites dipolar molecules causing molecular vibration (friction) heating. All these technologies can be used to melt the toner onto the substrate 16 to fix the toner to the substrate 16, and to achieve some level of surface finish.

Figure 3:
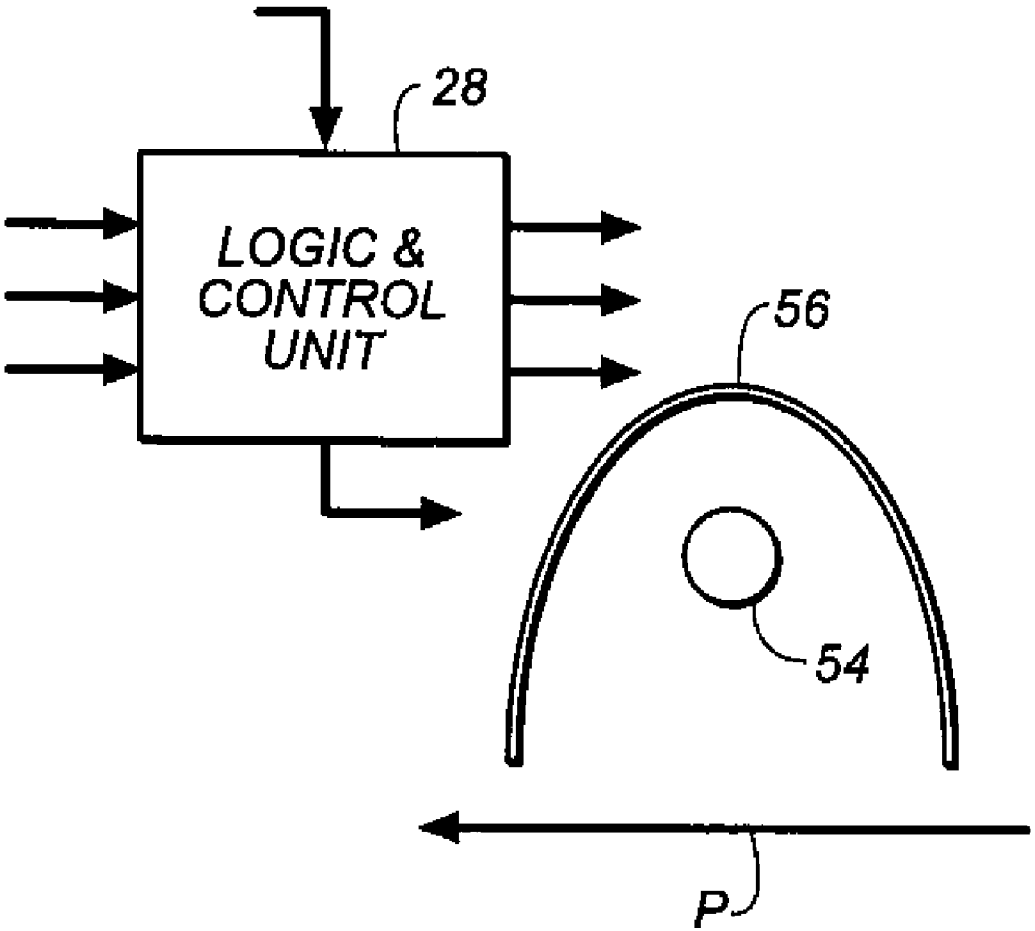
FIG. 3 shows a generic lamp and reflector for non-contact surface heating fusers.

Upon exiting non-contact fuser 18 the substrate enters the chill rollers 52 for final finishing to achieve the proper gloss and color density. Or if the desired level of gloss, and color density, are achieved, in the non-contact fuser 18 before entering the chill rollers 52, the chill rollers 52 can be bypassed. Each of these radiant heating technologies, such as Ultraviolet (UV) and near Infrared (IR) technologies, consist of a lamp element 54 (see FIG. 3) of the proper type, a reflector 56 to focus the energy, logic and control unit device 28, and a fire protection subsystem (not shown).

Figure 4:
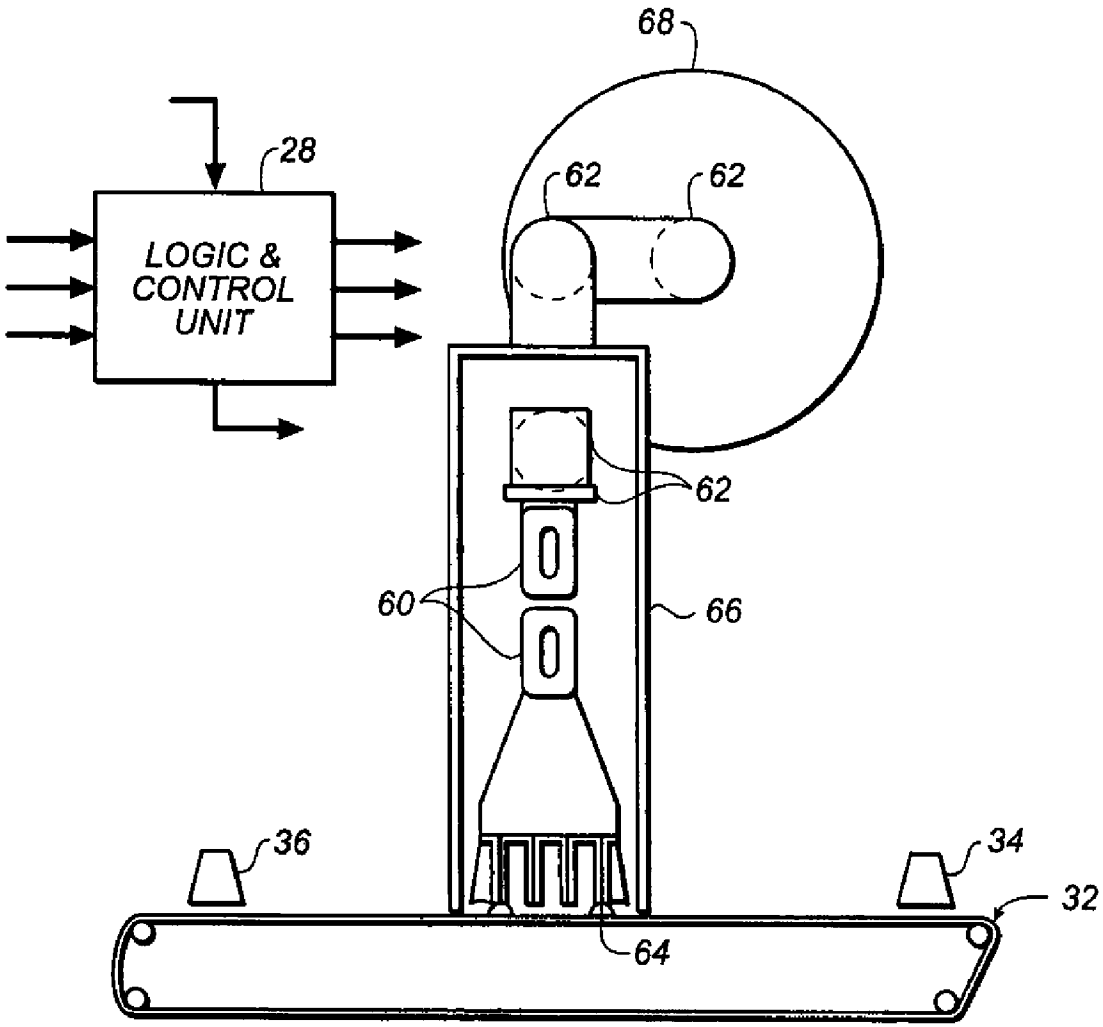
FIG. 4 shows a hot air fusing system on an electrostatic web substrate transport.
Figure 5:
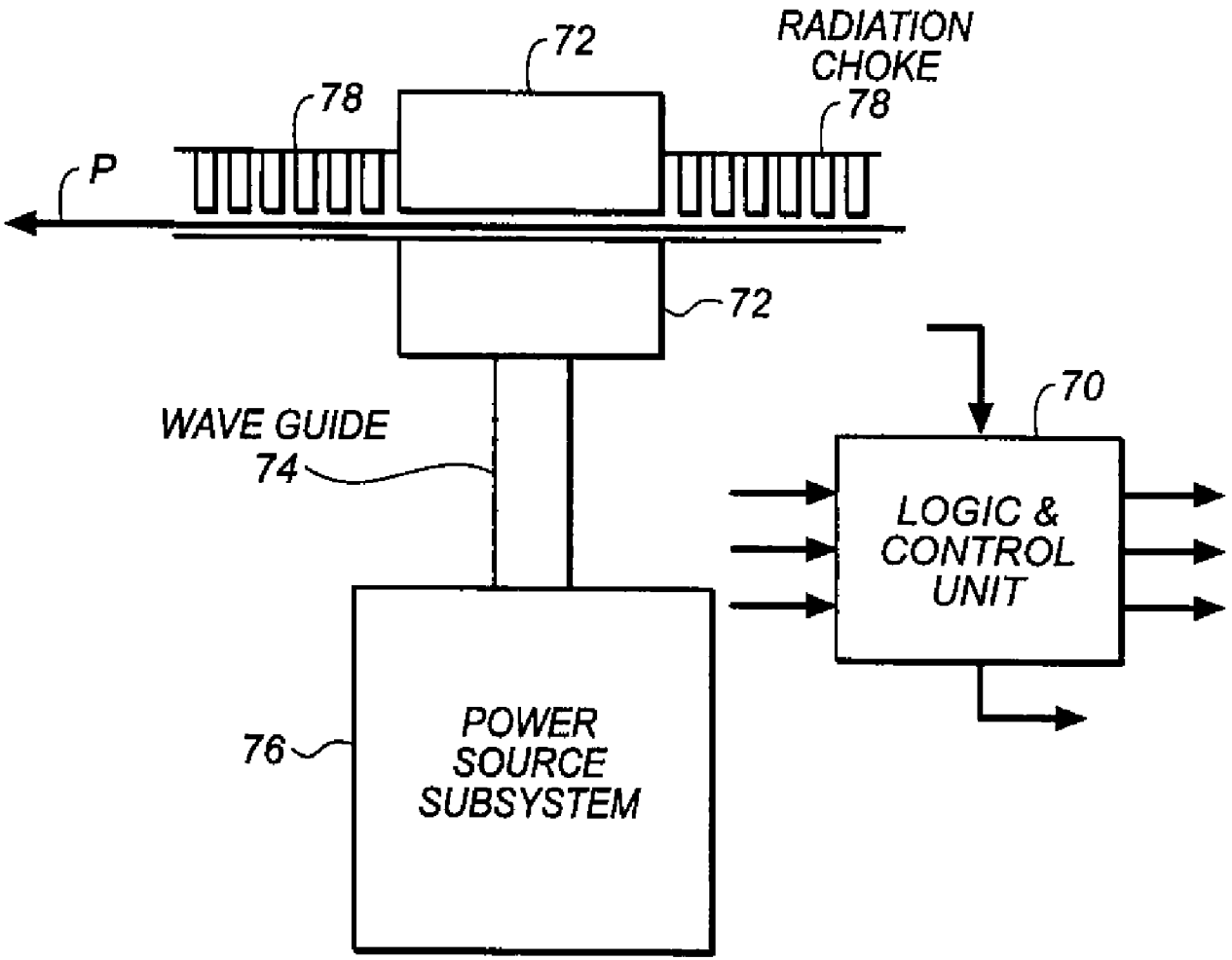
FIG. 5 shows a microwave fusing system.

Hot air technology (see FIG. 4) consists of heating elements 60, air ducts 62, exit jets 64, or porous screen, recirculation enclosure 66, blower 68, and logic and control unit device 28. Microwave technology (see FIG. 5) consists of an applicator subsystem 72, waveguide 74, power source subsystem 76, choke 78, and logic and control unit device 28.

Chilled Finish Rollers

A chilled finish roller subsystem would need a minimum of two rollers forming a pressure nip. Large diameter rollers can facilitate larger cooling dwells with larger nip widths, while small diameter rollers exhibit better toner-roller release qualities than a large rollers because of the higher peel rate. But, smaller rollers have less dwell time, thus having less cooling capability. In one embodiment the apparatus cools one or more toner layers from about 150° to about 80° C. or even from 100° to about 80° C.

Figure 7:
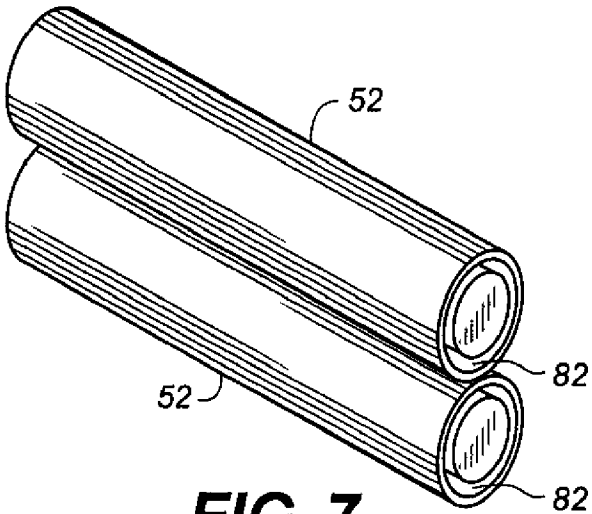
FIG. 7 shows a portion of the chilled finish roller subsystem including an internal liquid cooling system.
Figure 6:
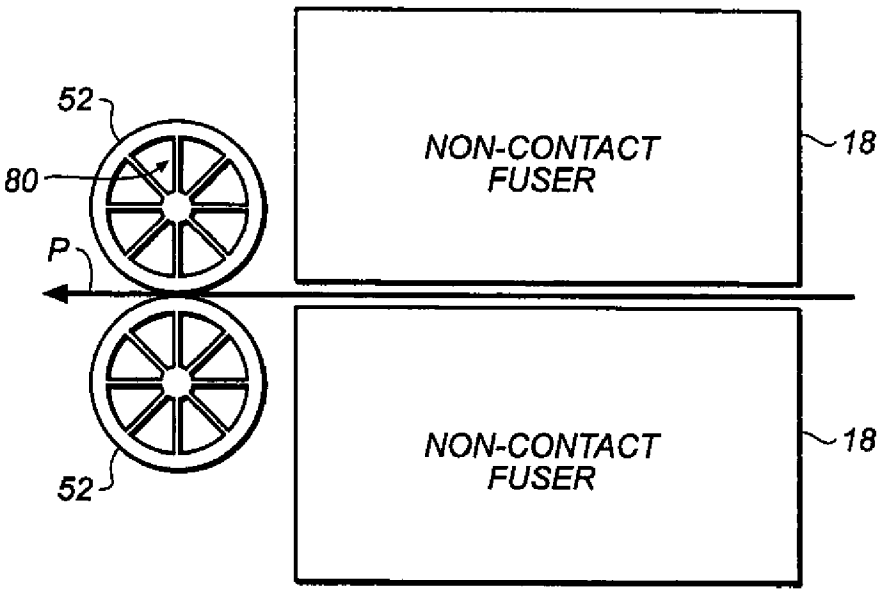
FIG. 6 shows a chilled finish roller subsystem including an internal air-cooling system.
Figure 9:
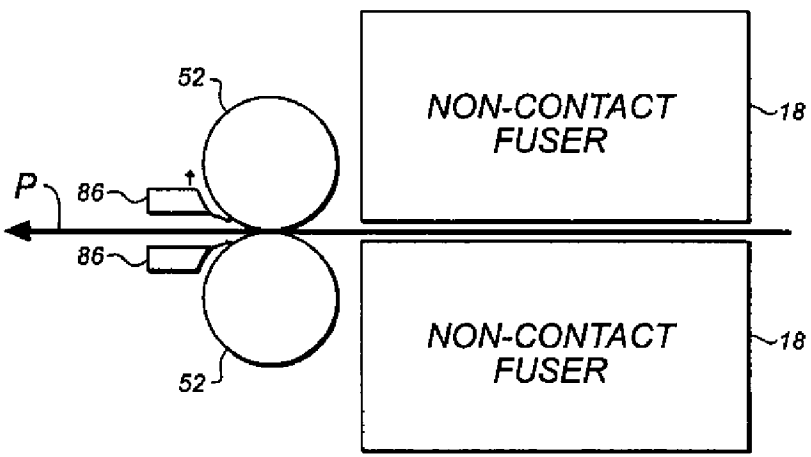
FIGS. 8 and 9 show a portion of the chilled finish roller subsystem including an external convective air-cooling system.
Figure 8:
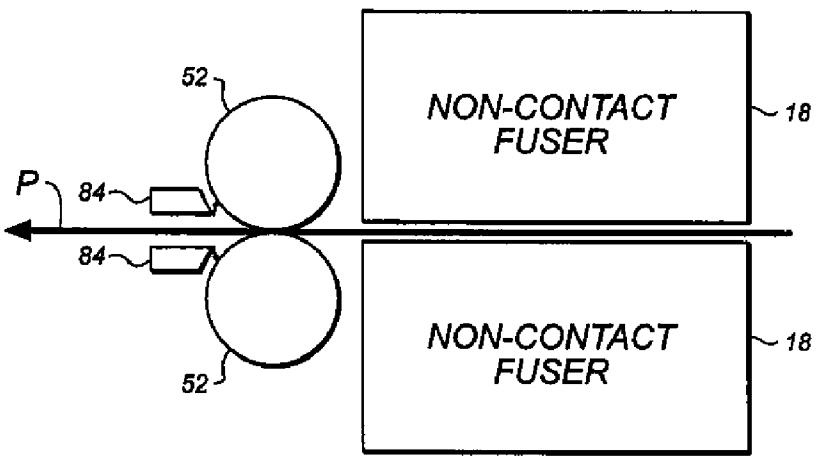

The chill roller 52 could be bare metal, anodized, or coated with a prescribed polymer finish. A means of cooling would be necessary. Internal air-cooling systems 80 (see FIG. 6) circulate cooling air to convectively cool the inside of the roller cores. Internal liquid cooling (see FIG. 7) would circulate liquid through the inside of the roller cores, through a jacket 82. External convective air-cooling (see FIGS. 8 and 9) could use air knives 84 and/or air skives 86 to cool the rollers' contact surfaces. Air skives 86 could have a dual purpose: cooling and stripping the substrate from the finishing roller surface.

Figure 10:
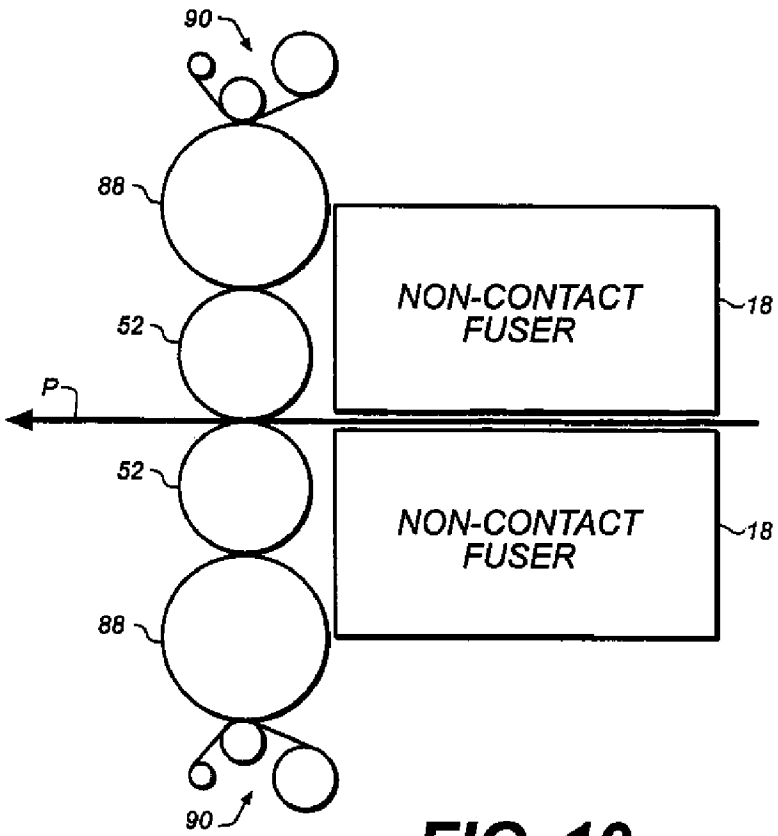
FIG. 10 shows a portion of the chilled finish roller subsystem including an external contact cooling system.

External contact cooling (see FIG. 10) can be used for high-speed processes where convective and internal cooling of the finishing rollers is not sufficient. In addition to the finishing chill rollers 52, a cooling roller 88 for each finishing chill roller 52 would be in contact. Each of these "external-cooling rollers" 88 could be cooled by external convective air or by internal liquid convection, or both. The addition of these external-cooling rollers 88 also adds stiffness to the finishing chill rollers 52, which allows for smaller diameter finishing chill rollers 52 than without. The benefit is a higher peel rate for substrate stripping from the finishing chill roller 52. A higher peel rate equates to a more reliable release from the finishing chill roller 52. In addition, a cleaning web 90 can be used on the external cooling rollers 88 since it will have a hard surface with high surface energy. The cleaning web and a hard surface facilitates a good cleaning configuration that will not produce significant image artifacts.

Figure 11:
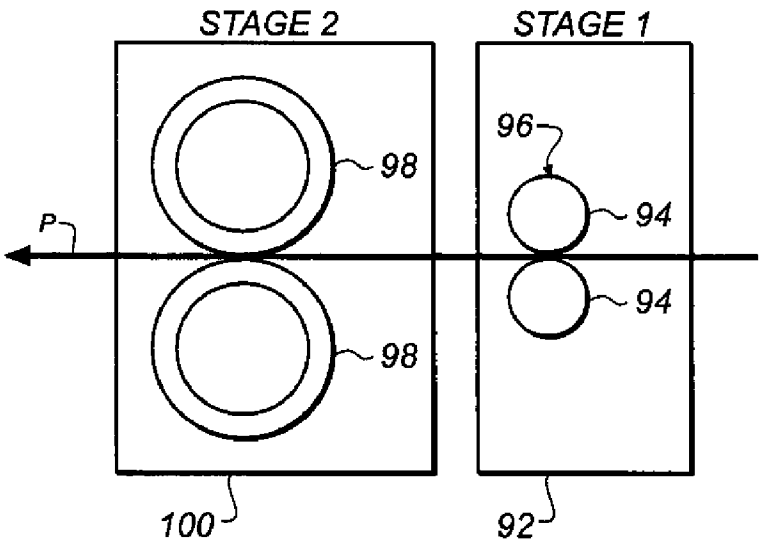
FIG. 11 shows one embodiment of the electrographic subsystem including a two-stage chilled finish roller system.

Another embodiment is the two-stage system (see FIG. 11) that consists of a calender 92 for the first stage, and cooling rollers for the second stage. A calender is a well-known device that applies pressure, with a pair of rollers, to a substrate to make it glossy: paper manufacturers use calenders to finish paper. The first stage is made of hard metal rollers 94, or hard metal rollers with a thin polymer coating, applying high pressure. The first stage would spread the toner while in a pliable state, while at the same time casting the roller surface 96 onto the toner. This would modulate the gloss to the desired levels. The second stage consists of rubber-coated rollers 98 with a relatively large pressure nip for aggressive cooling. The large pressure nip allows more cooling, by increasing the time (dwell) of contact between the substrate and the cool rollers, to reduce the final temperature to below the glass transition temperature of the toner. This freezes the crystallization process for the desired gloss with the increased cooling time (dwell), which increases the cooling rate. The slower the crystalline sites cool the lower the gloss, therefore making the cooling rate a factor.

Figure 12:
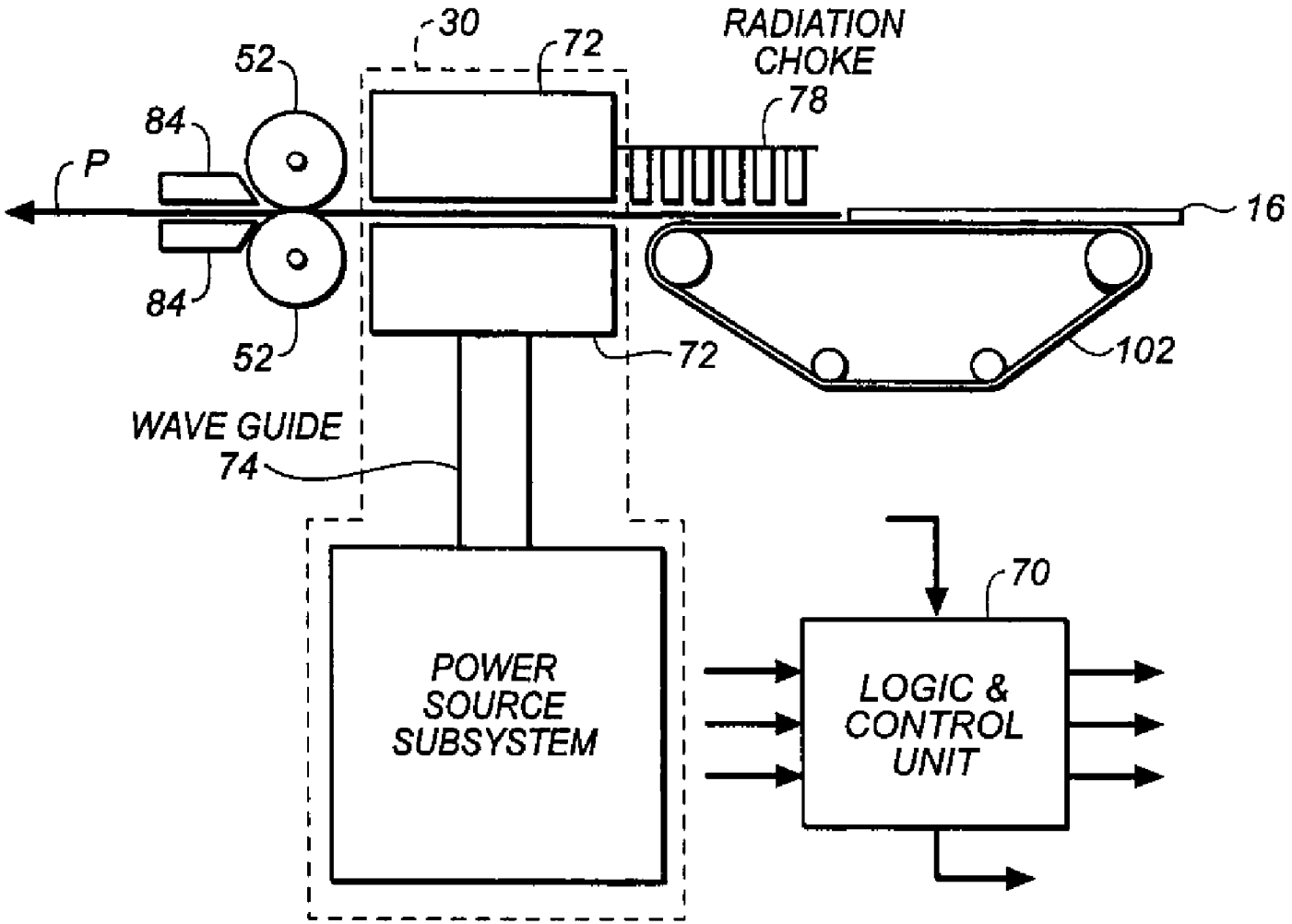
FIG. 12 shows a preferred embodiment.

One preferred embodiment is shown in FIG. 12, which includes a vacuum transport 102 leading into a microwave system 30 adjacent fuser 72. The chill rollers 52 are being cooled by air knifes 84. Microwave system 30 includes microwave power source 78, waveguide 76 and applicator 72. The device 74 is a radiation choke shield. The temperature of the chill rollers 52 is controlled by logic control unit 70 before printing, during printing and after printing to a temperature set point such that the desired opting temperature of chill rollers 52 is maintained before and during passage of receiver 16.

Substrate Transport and Non-Contact Fuser

In non-contact fusing there are interactions between the non-contact fuser 18 and substrate transport subsystem. Electrostatic web transports tend to add thermal energy to the substrate and toner during the fusing process, because the web 32 absorbs residual heat from the non-contact fuser 18. The web 32 can be used specifically to add thermal energy by heating it to the process limits: one limit would be image artifacts on the first side image during the second pass in duplex printing caused by re-melting the toner. Temperature limits of the web 32 depend on the fusing process materials (mainly toner glass transition temperature, $T_g$). Heated web rollers 40 or radiant lamps (IR) 42 can be used to heat the web 32. Avoiding backside (first side printed) image artifacts by maintaining a web temperature near the $T_g$ of the toner could be critical if the chill rollers 52 are not calendering the toner substrate system enough to resurface artifacts. The web temperature can be above the $T_g$ of the toner depending on the pressure applied by the electrostatic forces holding the substrate onto the web 32. A higher force would require a lower web temperature. Operating the web 32 at temperatures higher than the $T_g$ of the toner may require a low surface energy coating, such as Teflon, to facilitate toner release from the web 32. Web cooling, in addition to heating, may be necessary to control operating temperatures. This has been accomplished with air knives 44 in the past.

Web materials are required to have a high temperature (>/=100° C.) resistance for long periods of time: Polyimide (Kapton) webs, and Polyimide webs with a Supra-Teflon coating have been used, but may not be suitable for microwave fusing. For microwave fusing, a ceramic reinforced Teflon web would be suitable due to its transparency to the microwave energy EM energy.

Non-contact fuser 18 transport web heating, from the non-contact heating elements, creates the need to control the transport web temperature. Transport elements should be shielded from excess thermal energy escaping from a non-contact fuser 18. This can cause thermal imprinting (latent image) caused by uneven heating from transport components. Keeping components as cool as possible will also improve reliability by extending component life. If a curved paper path is used, a curved path through the fuser may be necessary.

Non-Contact Fuser and Substrate-Toner System

Non-contact fusers 18 have different interactions with toner and substrates depending on the heating physics employed. Surface heating and volumetric heating are the two different types of heating used by the technologies described in this document. Hot air, radiant flash, radiant IR, and radiant UV are surface heating technologies. Microwave fusing is a volumetric heating process.

Hot air (FIG. 4), radiant flash (FIG. 3), radiant IR (FIG. 3), and radiant UV (FIG. 3) technologies heat the toner-substrate system on the exposed radiated surface: this results in a thermal gradient through the substrate-toner thickness, where the hot side is the exterior surface, and the cold side is near the center of the substrate. These processes tend to heat the toner more than the substrate, especially if the image covers the majority of the substrate. Internal substrate vapor pressures are lower than in a volume heating process, especially if the volume heating process excites water molecules. Lower internal vapor pressure allows for higher fusing temperatures by raising the temperature at which paper blisters. To avoid fire hazards, these technologies need to have protection systems, such as Zeikon's "clam shell" design. The only exception is the hot air technology (FIG. 4) for which the heating elements 60 are remotely located.

Volumetric heating with high frequency electromagnetic radiation at 2.45 GHz (microwave spectrum) vibrates internal water molecules inside the substrate, which instantly begins to build internal vapor pressure. Virtually all the water molecules are being excited at the same time, not initially at the surface and working inward towards the center of the substrate, as in surface heating. Therefore, this process results in a higher final vapor pressure than surface heating methods at the same resulting surface temperature.

This process heats the substrate (volumetrically), and the substrate conductively transfers heat to the toner. This results in a thermal gradient through the substrate-toner thickness where the hot side is the interior (near the center), and the cold side is at the surface of the substrate. This also results in higher final vapor pressures that can cause paper blistering. This limits the maximum fusing temperature. This behavior makes toner formulation very critical because the fusing window is smaller due to the equipments' effect on the process. Toner, typically, flows better at higher temperatures: resulting in higher gloss (better wetting of the substrate surface at low color densities and more leveling of high color densities areas where the toner stack is thickest). Lower temperatures, typically, result in lower gloss.

Chilled Finish Rollers and Non-Contact Fuser

Chilled finish rollers 52 are used to adjust the gloss and color density that result from the non-contact fusing process. By applying a specified pressure, roller temperature, and a specified roller surface texture the gloss and color density can be adjusted to specified levels.

The chilled finish rollers 52 receive a substrate with toner on it that has already been heated to fusing temperatures, in a non-contact fuser 18. The temperature of the toner must be above its glass transition temperature when entering the chill rollers. The roller temperatures need to be at or below the glass transition temperature of the toner.

Substrate-Toner System and Chilled Finish Rollers

Toner-substrate release from a roller, in a chill rolling process, does not have the same difficulties with toner release as does a roller-fuser (with heated rollers). The solidification of toner, at the time of contact with the roller, reduces the adhesion forces to the roller (relative to roller fusing) while increasing the strength of the toner by cooling the material. A system with sufficiently small release forces does not need to use contact or air skiving 86 to release the substrate-toner system from the roller. In addition, fusing release fluid can be eliminated due to the small release forces.

Attaining the required gloss of a finished toner surface requires two forms of energy: roller nip pressure and toner cooling rate. Roller nip pressure spreads the toner, covering more substrate, and imparting the finish of the roller surface to the toner (casting), if using a prescribed roller finish. A faster cooling rate results in higher gloss due to the special sharp melting point toner additives. If crystalline additives are used, the crystallization process can be exploited. Slow cooling allows the crystals to grow larger than if they were cooled quickly. If the crystals can be stabilized in a state with the smallest possible size, the gloss would be its highest possible value.

The invention has been described in detail with particular reference to certain preferred embodiments thereof, but it will be understood that variations and modifications can be effected within the spirit and scope of the invention.

The invention claimed is:

1. A toner composition suitable for non-contact heating comprising:

a) an amorphous binder of a number average molecular weight between 1000 and 20,000 and having a glass transition temperature between 50 and 100 C, and b) crystalline rheology modifier capable of lowering the melt viscosity of the said polymer binder with a melting temperature in the range of 60 to 120 C.

2. The toner in claim 1, further having the half-width of the melting transition less than 10 C.

3. The toner in claim 1 further having a melt viscosity in the range of 200 to 20,000 poise or more preferably between 400 and 2000 poise.

4. The toner of claim 1, said toner heated during non-contact fusing to reach a fusing temperature above a glass transition temperature before cooling by a cooling roller to lower the toner to a temperature below said glass transition temperature.

5. The toner of claim 4, said cooling by said cooling roller at a specific cooling rate of change in temperature to achieve a desired receiver luster.

6. The toner of claim 4, said cooling by said cooler roller to cool the toner until it exhibits a sharp increase in a module of elasticity.

7. The toner of claim 1, further capable of being cooled quickly to stabilize crystals in a state with a smallest possible size to provide a highest possible gloss and being cooled more slowly to allow allows the crystals to grow larger than if they were cooled quickly to provide a level of gloss that is lower than the highest possible gloss.

* * * * *